US009670693B2

(12) United States Patent
Degre et al.

(10) Patent No.: US 9,670,693 B2
(45) Date of Patent: Jun. 6, 2017

(54) INTERCHANGEABLE LOCK ASSEMBLY

(71) Applicant: GDRM LLC, Novi, MI (US)

(72) Inventors: Eugene A. Degre, Holden, MA (US); Robert M. Massard, Novi, MI (US)

(73) Assignee: GDRM LLC, Novi, MI (US)

( * ) Notice: Subject to any disclaimer, the term of this patent is extended or adjusted under 35 U.S.C. 154(b) by 102 days.

(21) Appl. No.: 14/801,022

(22) Filed: Jul. 16, 2015

(65) Prior Publication Data

US 2016/0017635 A1 Jan. 21, 2016

Related U.S. Application Data

(60) Provisional application No. 62/026,072, filed on Jul. 18, 2014.

(51) Int. Cl.
*E05B 17/04* (2006.01)

(52) U.S. Cl.
CPC ..... *E05B 17/041* (2013.01); *E05B 17/04* (2013.01)

(58) Field of Classification Search
CPC ..... E05B 17/04; E05B 17/041
USPC ..... 70/370–373, 375, 451, 379 R, 380
See application file for complete search history.

(56) References Cited

U.S. PATENT DOCUMENTS 3,078,706 A * 2/1963 Russell ..... E05B 17/04 70/419
3,123,995 A * 3/1964 Russell ..... E05B 17/04 292/336.3
3,404,549 A * 10/1968 Best ..... E05B 9/04 70/370
4,672,828 A * 6/1987 Theriault ..... E05B 63/0065 70/373
4,793,166 A * 12/1988 Marks ..... E05B 17/04 292/DIG. 52
5,174,136 A * 12/1992 Thwing ..... E05B 17/04 70/371
5,249,444 A * 10/1993 Dancs ..... E05B 17/0012 292/DIG. 64
5,884,512 A * 3/1999 Wayne ..... E05B 9/084 70/370
6,145,356 A * 11/2000 Thwing ..... E05B 9/084 70/371
6,314,774 B1 * 11/2001 Andersson ..... E05B 27/0053 70/357
6,758,075 B1 * 7/2004 Thwing ..... E05B 11/00 70/372

(Continued)

*Primary Examiner* — Suzanne Barrett
(74) *Attorney, Agent, or Firm* — Warner Norcross & Judd LLP

(57) ABSTRACT

A lock assembly includes a lock housing with an annular wall separating an end wall and a face. A core is received in an opening disposed in the face. The core defines a keyway disposed in rotational engagement with an end portion for actuating the lock assembly between locked and unlocked positions. A drive member is rotationally interconnected with the end wall of the housing. The drive member is disposed in driven engagement with the end portion of the core. An adapter defines a generally X-shaped slot and is fixedly attached to the end portion. A tail piece is received by the slot. The tail piece defines an elongated substantially flat appendage including a proximal end retained in the adapter and a distal end extending outwardly from the adapter. The proximal end is twisted relative to the distal end between generally 40 and 50 degrees.

10 Claims, 2 Drawing Sheets

(56) References Cited

U.S. PATENT DOCUMENTS

| | | | | |
|---|---|---|---|---|
| 6,883,356 | B1 * | 4/2005 | Wu | E05B 9/086 70/372 |
| 8,240,178 | B2 * | 8/2012 | Massard | E05B 9/04 70/370 |
| 2005/0011239 | A1 * | 1/2005 | Lurie | E05B 9/086 70/369 |
| 2009/0044579 | A1 * | 2/2009 | Hartman | E05B 17/04 70/367 |

* cited by examiner

INTERCHANGEABLE LOCK ASSEMBLY

PRIOR APPLICATIONS

This application claims priority to U.S. Provisional Patent Application No. 62/026,072 filed on Jul. 18, 2014.

TECHNICAL FIELD

The present invention relates generally to a lock assembly for locking and unlocking a door using a key. More specifically, the present invention relates to improvements for an interchangeable lock assembly.

BACKGROUND

Efforts have been made to reduce the technical difficulty with converting a lock assembly to use a new key. One such attempt is disclosed in U.S. Pat. No. 8,240,178, the contents of which are incorporated herein by reference, where an inventive core capable of use in a variety of different lock configurations such as, for example, a mortis cylinder in a rim cylinder is disclosed. Although a significant enhancement to prior art lock assemblies is disclosed, further improvements to the device disclosed in U.S. Pat. No. 8,240,178 would be advantageous to easily facilitate changing a lock core.

Therefore, it would be desirable to improve upon the prior art interchangeable lock assembly.

SUMMARY

A lock assembly of the present invention includes a lock housing that is defined by an annular wall separating an end wall and a face. A core is received in an opening disposed in the face of the housing. The core defines a key way disposed in rotational engagement with an end portion for actuating the lock assembly into locked and unlocked positions. A drive member is rotationally interconnected with the end wall of the housing. The drive member is disposed in driven engagement with the end portion of the core. An adapter defines a slot and is fixedly attached to the end portion. A tail piece is received by the slot disposed in the adapter. The tail piece defines an elongated substantially flat appendage including a distal end retained in the adapter and a proximal end extending outwardly from the adapter. The proximal end is twisted relative to the distal end between about forty and fifty 50 degrees. The slot defined by the adapter defines a generally X-shaped opening with intersecting legs, each of which are configured to receive the tail piece, depending on a desired orientation of the tail piece prior to installation.

The X-shaped opening disposed in the adapter provides alternate dispositions for inserting the tail piece through the slot prior to engagement with the drive member. Furthermore, the twist of between 40 and 50 degrees displacing the distal end of the tail piece from the proximal end of the tail piece ensuring that regardless of the disposition of the tail piece in the x-shaped opening, the tail piece is oriented in a manner that easily facilitates installation of the lock assembly.

BRIEF DESCRIPTION OF THE DRAWINGS

Other advantages of the present invention will be readily appreciated, as the same becomes better understood by reference to the following detailed description when considered in connection with the accompanying drawings, wherein.

DETAILED DESCRIPTION

Figure 1A:
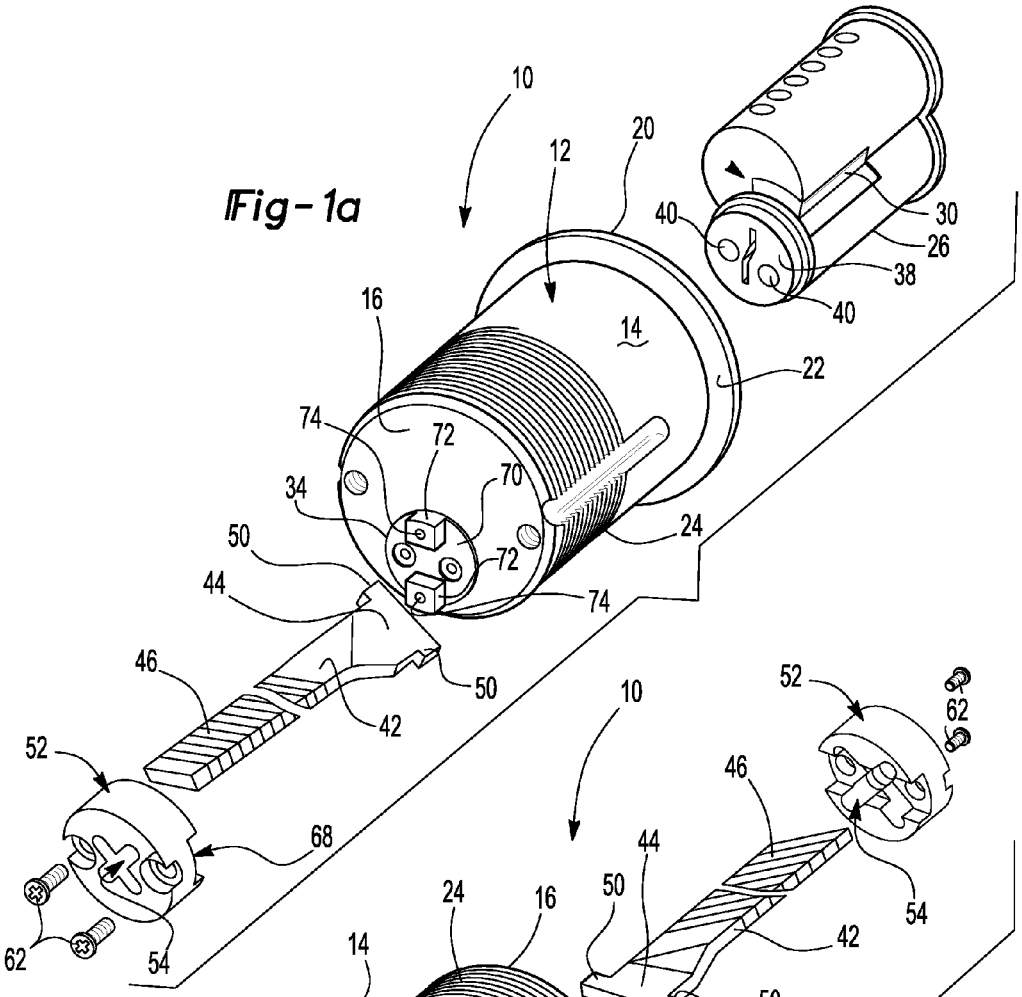
FIGS. 1*a* and 1*b* show an expanded view of the lock assembly of the present invention.
Figure 1B:
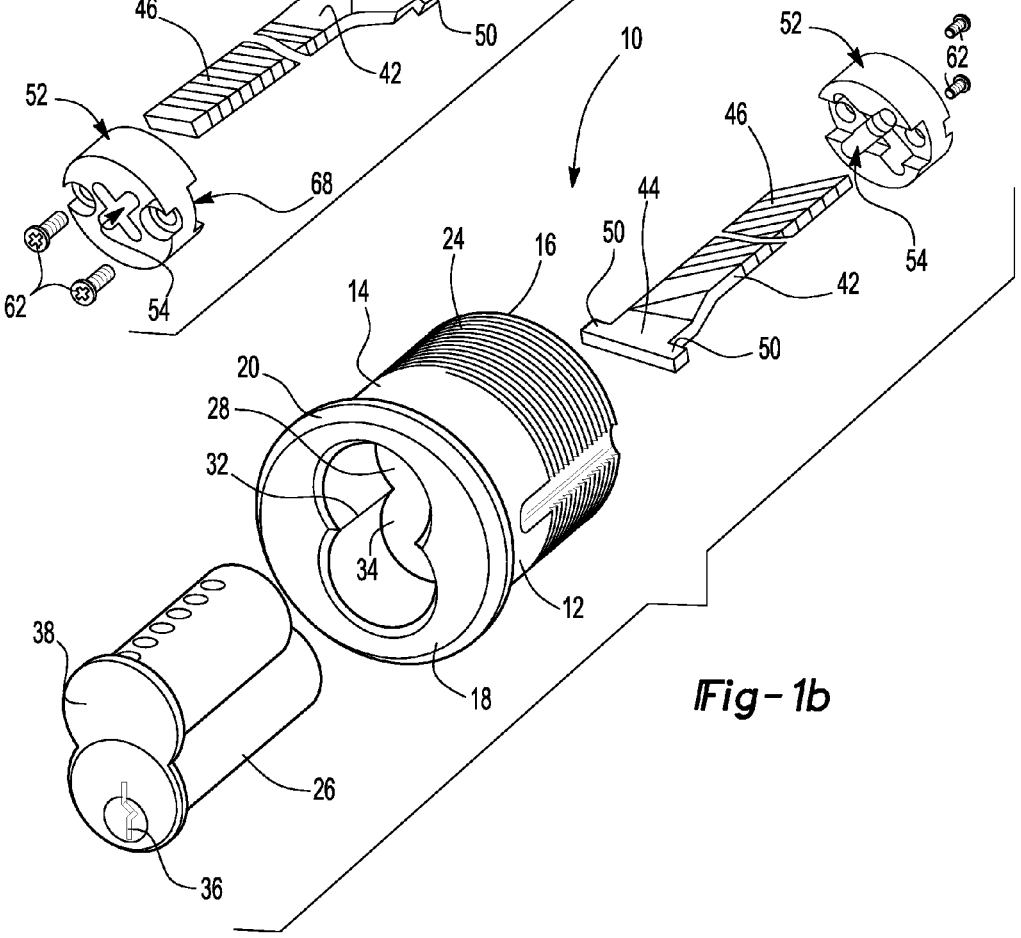

An exploded view of the lock assembly is generally shown in FIGS. 1*a* and 1*b* at 10. The assembly 10 includes a housing 12. The housing 12 is defined by an annular wall 14 separating an end wall 16 and a face 18. The face 18 includes a rim 20 providing a shoulder 22 that abuts a face of a door (not shown) in a known manner. The annular wall 14 of the housing 12 includes a threaded surface 24 to threadably mount the housing 12 onto the door in a known manner. A core 26 is received in a core opening 28 disposed in the face 18 of the housing 12. The core opening 28 is configured to receive the core 26 by having a complimentary configuration to the shape of the core 26, such as, for example, parallel cylindrically shape members 27,29. The core 26 includes a retractable engagement member 30 that interlocks with a locking feature 32, which is disposed inside the housing 12, in a known manner.

A drive member 34 (best shown in FIG. 1*a*) is rotationally interconnected with the end wall 16 of the housing 20 and receives rotary movement by rotating a key (not shown) inserted into key way 36 disposed in an exposed face 38 of the core 26. As such, an end portion 38 is rotated by the key translating rotational motion to the drive member 34 via pin receptors 40 in a known manner. It should be understood by those of ordinary skill in the art that the drive member 34, and that which is described below enables the lock assembly 10 of the present invention to be universally received by mortis assemblies, rim assemblies and the like.

A tail piece 42 defines an elongated substantially flat appendage having a proximal end 44 and a distal end 46. The proximal end 44 is twisted relative to the distal end 46 by between generally forty and fifty degrees. More specifically, the proximal end 44 is twisted about forty five degrees from the distal end 46. The proximal end 44 of the tail piece 42 defines opposing legs 50 that extend outwardly from the tail piece 42, the purpose of which will become more evident further herein below.

Figure 2:
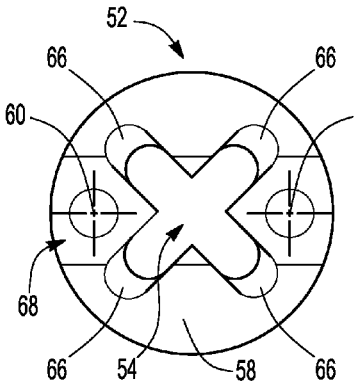
FIG. 2 shows a rear view of an adapter of the present invention.
Figure 3:
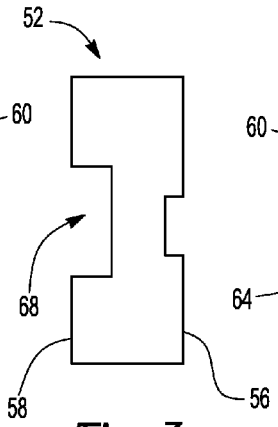
FIG. 3 show a side view of the adapter.
Figure 4:
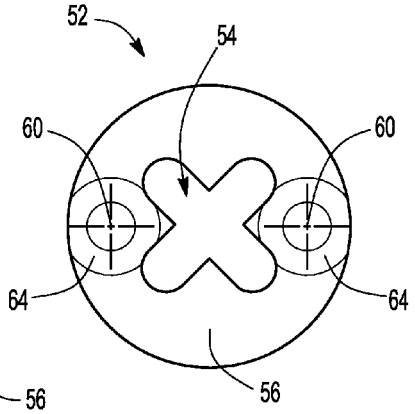
FIG. 4 shows a front view of the adapter.
Figure 5:
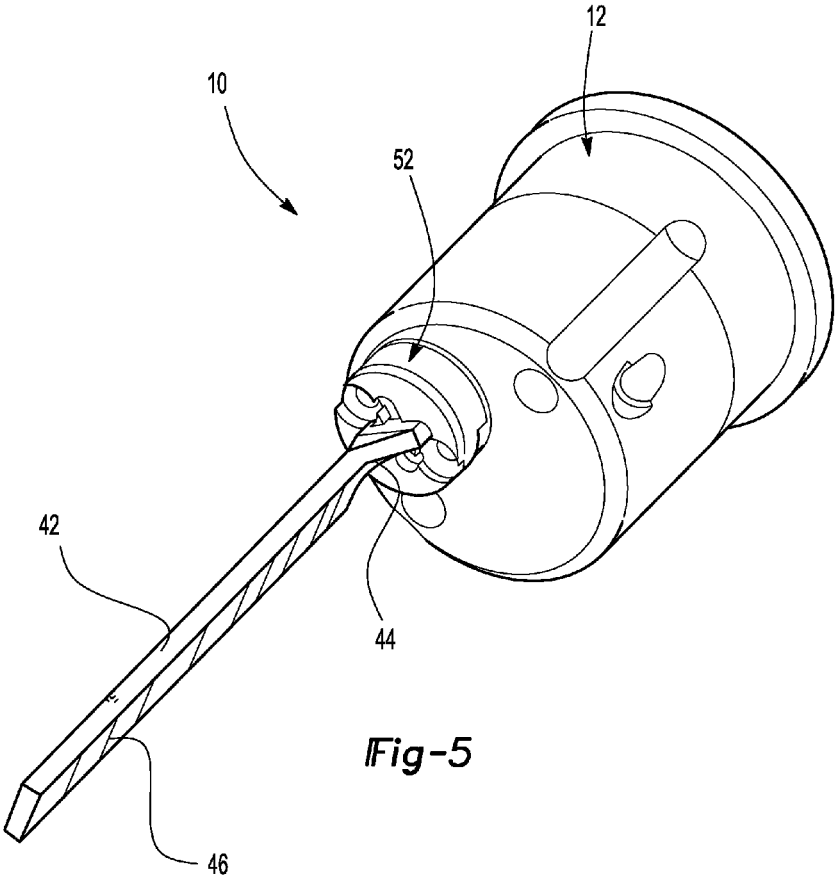
FIG. 5 shows a perspective view of the lock assembly of the present invention.

Referring now to FIGS. 2, 3, and 4, a novel adapter is generally shown at 52. The adapter 52 defines a slot 54 forming a generally X-shaped opening through a front surface 56 to a back surface 58 by way of intersecting slot elements. A pair of fastener apertures 60 are disposed between appendages of the X-shaped slot 54 for receiving fasteners 62 (at FIGS. 1*a*, 1*b*), the purpose of which will be explained further herein below. The fastener aperture 60 each include a chamfer disposed upon the front surface 56 of the adapter 52 to facilitate installation of the fasteners 62. The X-shaped slot 54 includes a slot chamfer 66 disposed upon the back surface 58 of the adapter 52 to facilitate inserting the tail piece 42 into the slot 54. A groove 68 is disposed upon the back surface 58 of the adapter 52 to receive a drive element 70 for translating rotationally motion from the drive member 34 to the adapter 52.

The tail piece 42 is received in the adapter 52 through slot 54 in two different orientations via the X-shaped configuration of the slot 54. This enables the proximal end 44 of the tail piece 42 to be disposed between spaced protrusions 72 that define the drive element 70. The twist disposed in the tail piece 42 orients the distal end 46 of the tail piece 42 in an easily installed position when meeting the housing 12. For example, the distal end 46 of the tail piece 42 is disposed in either a vertical or a horizontal orientation depending upon which of the intersecting slot elements of the slot the proximal end 44 of the tail piece is disposed. The fasteners 62 secure the adapter 52 to the drive member 34 via a receptor 74 disposed in each of the spaced protrusions 72.

Obviously, many modifications and variations of the present invention are possible in light of the above teachings foregoing invention has been described in accordance with the relevant legal standards; thus, the description is merely exemplary rather than limiting in nature. Variations and modifications to the disclosed embodiment may become apparent to those skilled in the art and do come within the scope of the invention. Accordingly, the scope of the legal protection afforded this invention can only be determined by studying the following claims.

What is claimed is:

1. A lock assembly, comprising:

a housing defined by an annular wall separating an end wall and a face;

a core received in an opening disposed in said face of said housing, said core defining a keyway disposed in rotational engagement with an end portion for actuating said lock assembly into a locked and an unlocked position;

a drive member being rotationally interconnected with said end wall of said housing and being disposed in driven engagement with said end portion of said core;

an adapter defining a slot and being fixedly attached to said end portion;

a tail piece received by said slot disposed in said adapter, said tail piece defining an elongated substantially flat appendage including a proximal end being retained in said adapter and a distal end extending outwardly from said adapter with said proximal end being twisted relative to said distal end by between about forty and fifty degrees; and said slot forming a generally X-shaped opening defined by intersecting slot elements each being configured to receive said tail piece.

2. The assembly set forth in claim 1, wherein said adapter includes a mating face for mating with said drive member.

3. The assembly set forth in claim 2, wherein said mating face defines a groove and said drive member includes a drive element received by said groove for transferring radial motion to said tail piece.

4. The assembly set forth in claim 3, wherein said drive element includes spaced protrusions receiving said proximal end of said tail piece therebetween.

5. The assembly set forth in claim 1, wherein said proximal end of said tail piece defines opposing legs extending outwardly from said tail piece for retaining said tail piece in said adapter.

6. The assembly set forth in claim 3, wherein said adapter includes a pair of apertures disposed adjacent opposite ends of said slot.

7. The assembly set forth in claim 6, wherein said spaced protrusions each include a receptor disposed in alignment with one of said pair of apertures receiving a fastener inserted through said apertures thereby fixedly attaching said adapter to said drive element.

8. The assembly set forth in claim 1, wherein said intersecting slot elements are chamfered for facilitating inserting said tail piece into said slot.

9. The assembly set forth in claim 1, wherein said proximal end of said tail piece is twisted relative to said distal end of said tail piece by about forty five degrees.

10. The assembly set forth in claim 1, wherein said distal end is disposed in either a vertical or a horizontal orientation as guided by which of said slot elements said proximal end is disposed.

* * * * *